US006758553B2

(12) United States Patent
Hirota et al.

(10) Patent No.: US 6,758,553 B2
(45) Date of Patent: Jul. 6, 2004

(54) INKJET HEAD FOR INKJET PRINTING APPARATUS

(75) Inventors: Atsushi Hirota, Aichi-ken (JP); Hidetoshi Watanabe, Aichi-ken (JP); Atsuo Sakaida, Gifu-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 48 days.

(21) Appl. No.: 10/305,949

(22) Filed: Nov. 29, 2002

(65) Prior Publication Data

US 2003/0103114 A1 Jun. 5, 2003

(30) Foreign Application Priority Data

Nov. 30, 2001 (JP) ..... 2001-367701
Dec. 5, 2001 (JP) ..... 2001-371148

(51) Int. Cl.[7] ..... B41J 2/045; B41J 2/155
(52) U.S. Cl. ..... 347/68; 347/42
(58) Field of Search ..... 347/68, 70–72, 347/40, 42, 49

(56) References Cited

U.S. PATENT DOCUMENTS

| | | | | |
|---|---|---|---|---|
| 3,586,907 A | | 6/1971 | Beam et al. | |
| 3,836,913 A | | 9/1974 | Burnett et al. | |
| 4,536,097 A | | 8/1985 | Nilsson | |
| 4,617,581 A | | 10/1986 | Koto et al. | |
| 4,695,854 A | | 9/1987 | Cruz-Uribe | |
| 4,812,859 A | | 3/1989 | Chan et al. | |
| 5,087,930 A | | 2/1992 | Roy et al. | |
| 5,160,945 A | | 11/1992 | Drake | |
| 5,402,159 A | | 3/1995 | Takahashi et al. | |
| 5,914,743 A | | 6/1999 | Tagashira et al. | |
| 6,250,738 B1 | * | 6/2001 | Waller et al. | 347/42 |
| 6,457,810 B1 | * | 10/2002 | King et al. | 347/49 |

FOREIGN PATENT DOCUMENTS

| | | |
|---|---|---|
| EP | 0 985 536 A1 | 3/2000 |
| JP | A 61-283554 | 12/1986 |
| JP | B2 2-4429 | 1/1990 |
| JP | B2 7-67803 | 7/1995 |
| JP | B2 2752843 | 2/1998 |

* cited by examiner

*Primary Examiner*—Judy Nguyen
(74) *Attorney, Agent, or Firm*—Oliff & Berridge PLC

(57) ABSTRACT

An inkjet head employed in an inkjet printing apparatus includes a main body provided with a printing surface, which has a substantially rectangular elongated shape, and a plurality of piezoelectric modules. Each of the piezoelectric modules has a substantially trapezoidal shape, and is provided with a plurality of piezoelectric unit structures. The plurality of piezoelectric modules are arranged along a longitudinal direction of the printing surface such that upper base of the trapezoidal shape is located at a central portion in a direction perpendicular to the longitudinal direction. Further, the plurality of piezoelectric modules are oriented in opposite directions alternately in the direction perpendicular to the longitudinal direction.

10 Claims, 6 Drawing Sheets

INKJET HEAD FOR INKJET PRINTING APPARATUS

BACKGROUND OF THE INVENTION

The present invention relates to an inkjet head for an inkjet printing apparatus, and more particularly, an inkjet head provided with a piezoelectric element unit having a unit matrix of a plurality of piezoelectric devices.

Conventionally, an inkjet head employing a laminated type piezoelectric actuator has been known. An example of such an inkjet head is disclosed in U.S. Pat. No. 5,402,159, teachings of which are incorporated herein by reference. The inkjet head according to the above-described patent, a plate type piezoelectric actuator, which includes a plurality of laminated piezoelectric sheets, is adhered onto a cavity plate formed with a plurality of nozzles and corresponding pressure chambers.

In Japanese Patent Publications of examined applications No. HEI 2-4429 or No. HEI 7-67803, an inkjet head having a cavity plate provided with rhombic pressure chambers is disclosed.

In Japanese Patent No. 2,752,843, a thermal inkjet head having a width same as the width of a recording sheet is disclosed. The inkjet head is configured such that a plurality of rectangular-shaped printing head sub-units (i.e., piezoelectric device unit) are arranged on a stick type support. Specifically, the plurality of sub-units are arranged in a zigzag pattern along the stick type support, with a part thereof overlapped in the sheet width direction. When an image is printed using the head, a sheet is fed in a direction perpendicular to the longitudinal direction of the stick type support.

According to the configuration of the inkjet head disclosed in the Japanese Patent 2,752,843, a plurality of sub-units are linearly arranged, with spaced by a certain amount with each other, along the longitudinal direction of the stick type support, and a pair of the linearly arranged sub-units are aligned in a sheet feed direction (i.e., a direction perpendicular to the longitudinal direction of the stick type support), such that the sub-units arranged on the different lines slightly overlap in the longitudinal direction. Due to this configuration, a relatively large room for accommodating the sub-units is required. With the above configuration, a utility efficiency is relatively high although the slightly overlapped portions exist. However, since the length of the entire area of the sub-units in the sheet feed direction is relatively large, a position where the ink is ejected from the inkjet head to the sheet is widened in the sheet feed direction. It is required that the position where the ink is ejected is as flat as possible, a platen roller or the like is required to have a larger diameter. Accordingly, components around the inkjet head, including sheet feeding mechanisms, as well as the inkjet head itself are relatively large, which makes it difficult to downsize the entire printing apparatus.

SUMMARY OF THE INVENTION

The present invention is advantageous in that an inkjet head and sheet feeding mechanisms can be downsized, and accordingly, a compact inkjet head which is elongated in the sheet width direction can be provided.

According to an embodiment of the invention, there is provided an inkjet head employed in an inkjet printing apparatus, which is provided with a main body provided with a printing surface having a substantially rectangular elongated shape, and a plurality of piezoelectric modules. Each of the piezoelectric modules has a substantially trapezoidal shape, and is provided with a plurality of piezoelectric unit structures. The plurality of piezoelectric modules are arranged along a longitudinal direction of the printing surface such that upper base of the trapezoidal shape is located at a central portion in a direction perpendicular to the longitudinal direction. Further, the plurality of piezoelectric modules are oriented in opposite directions alternately in the direction perpendicular to the longitudinal direction.

With this configuration, the inkjet head can be downsized, and thereby a space occupied by the inkjet head and sheet feed mechanisms employed in the inkjet printing apparatus can be reduced.

Optionally, the trapezoidal shape may be formed such that a first angle, which formed by the lower base and a first side connecting one side of the upper base and one side of the lower base, is different from a second angle, which formed by the lower base and a first side connecting the other side of the upper base and the other side of the lower base.

In a particular case, the first angle may be greater than the second angle, and the plurality of piezoelectric modules may be arranged on the printing surface such that the end sides of the arranged plurality of piezoelectric modules are the first sides.

With this arrangement, the utility efficiency of the piezoelectric structures is improved.

Optionally, at least two adjoining piezoelectric modules may be arranged such that the second sides thereof face each other with a predetermined distance therebetween.

Further optionally, the main body may be defined with a plurality of pressure chambers located at positions corresponding to the plurality of piezoelectric unit structures and manifolds through which ink is supplied to the plurality of pressure chambers. The manifolds may include a first manifold and a second manifold at an area defined by the second sides of the trapezoidal shapes of each adjoining two piezoelectric modules. In this case, the first manifold and second manifold may be spaced by a predetermined distance at the area defined by the second sides of each adjoining two piezoelectric modules.

With this configuration, manifolds capable of supplying sufficient amount of ink and still having sufficient mechanical rigidity can be realized.

Further optionally, the inkjet head may include ink inlets through which ink is supplied to the inkjet head, the ink inlets being arranged at portions corresponding to areas each surrounded by three adjoining piezoelectric modules.

In a particular case, all the trapezoidal shape may be identical. Accordingly, fabrication process for the piezoelectric modules can be simplified, which reduces the fabrication cost.

BRIEF DESCRIPTION OF THE ACCOMPANYING DRAWINGS

DETAILED DESCRIPTION OF THE EMBODIMENT

Hereinafter, a preferred embodiment of the invention will be described with reference to the accompanying drawings.

Firstly, a main body of an inkjet head according to an embodiment of the invention will be described.

Figure 4:
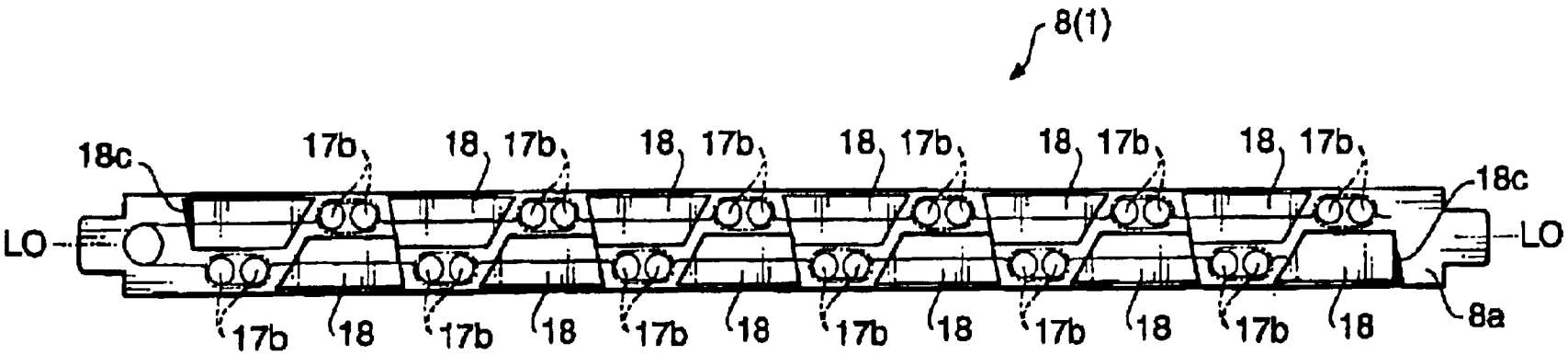
FIG. 4 is a plan view of the inkjet head according to the embodiment.

FIG. 4 is a plan view of the inkjet head 1 according to the embodiment. The inkjet head 1 is employed in an inkjet printing apparatus, which records an image on a recording sheet by ejecting inks in accordance with image data. The inkjet head 1 has a main body 8 which has an elongated substantially rectangular shape. On a printing surface 8*a* defined on the main body 8, a plurality of trapezoidal piezoelectric modules 18 are arranged.

Figure 3:
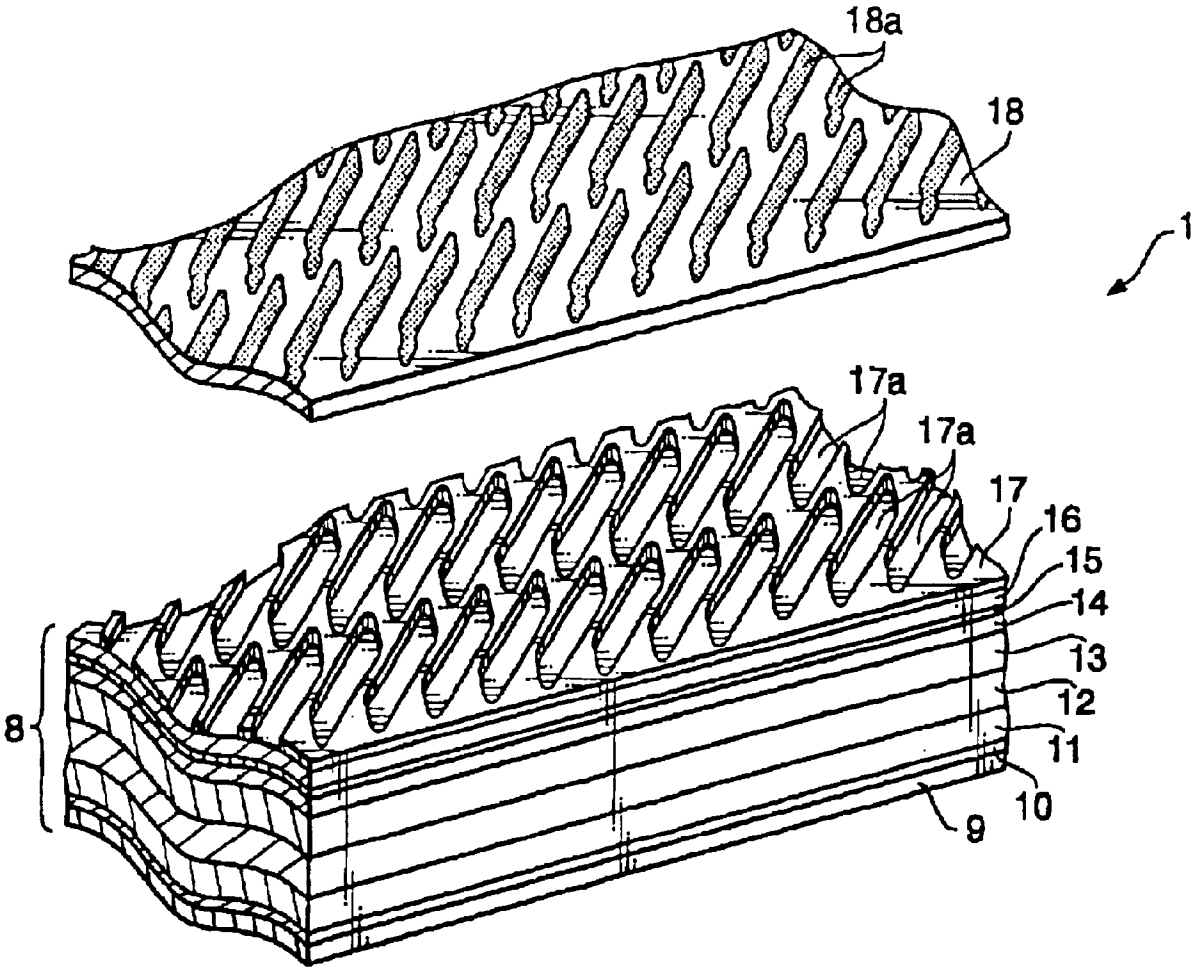
FIG. 3 is an exploded view of a part of the main body and a part of a piezoelectric unit.
Figure 7:
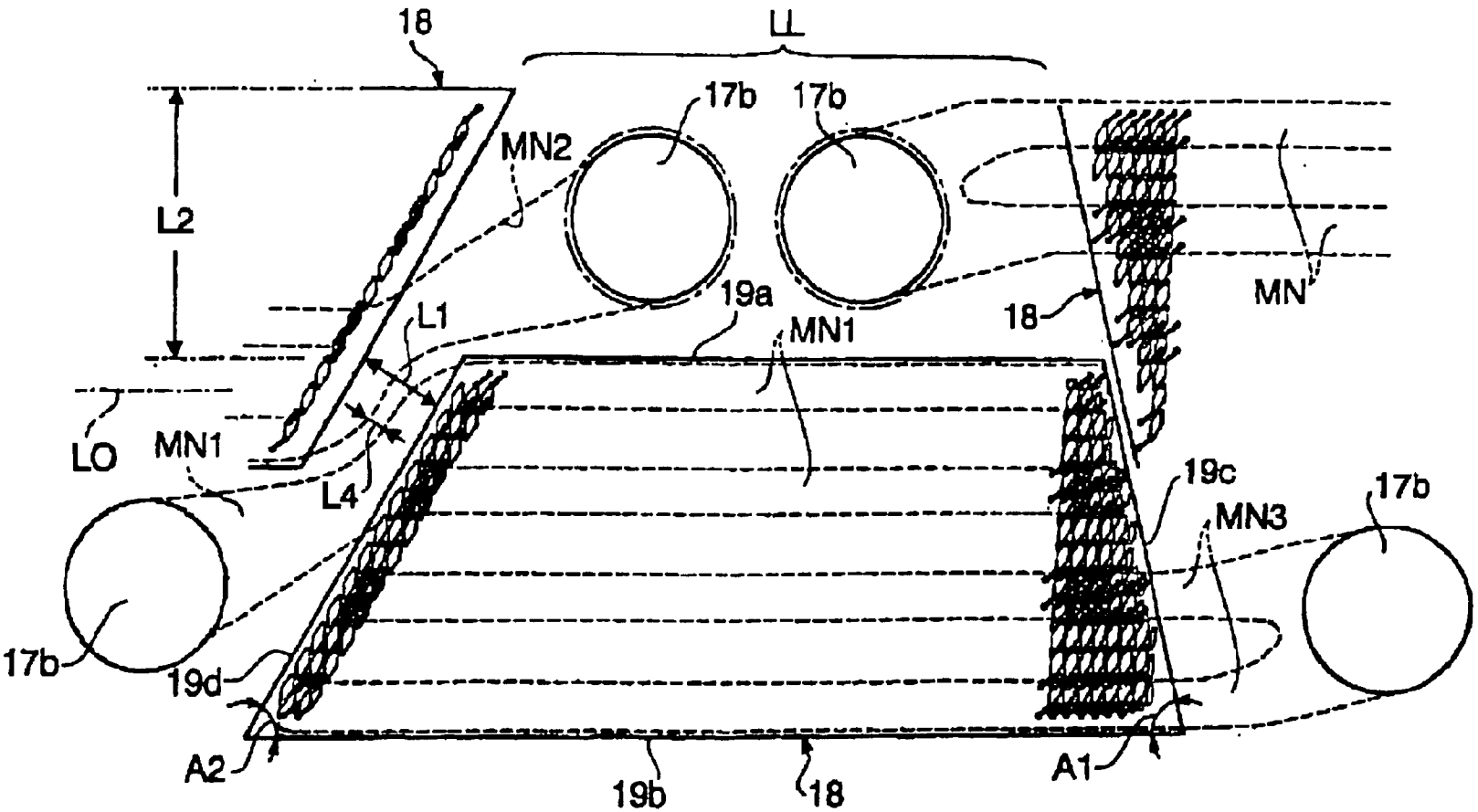
FIG. 7 is an enlarged plan view of a piezoelectric unit employed in the inkjet head.

FIG. 7 is an enlarged plan view of an ink ejecting module 18 together with part of adjoining ink ejecting modules 18. FIG. 3 is a perspective view of a part of the main body 8 and a part of the piezoelectric module 18.

Figure 2:
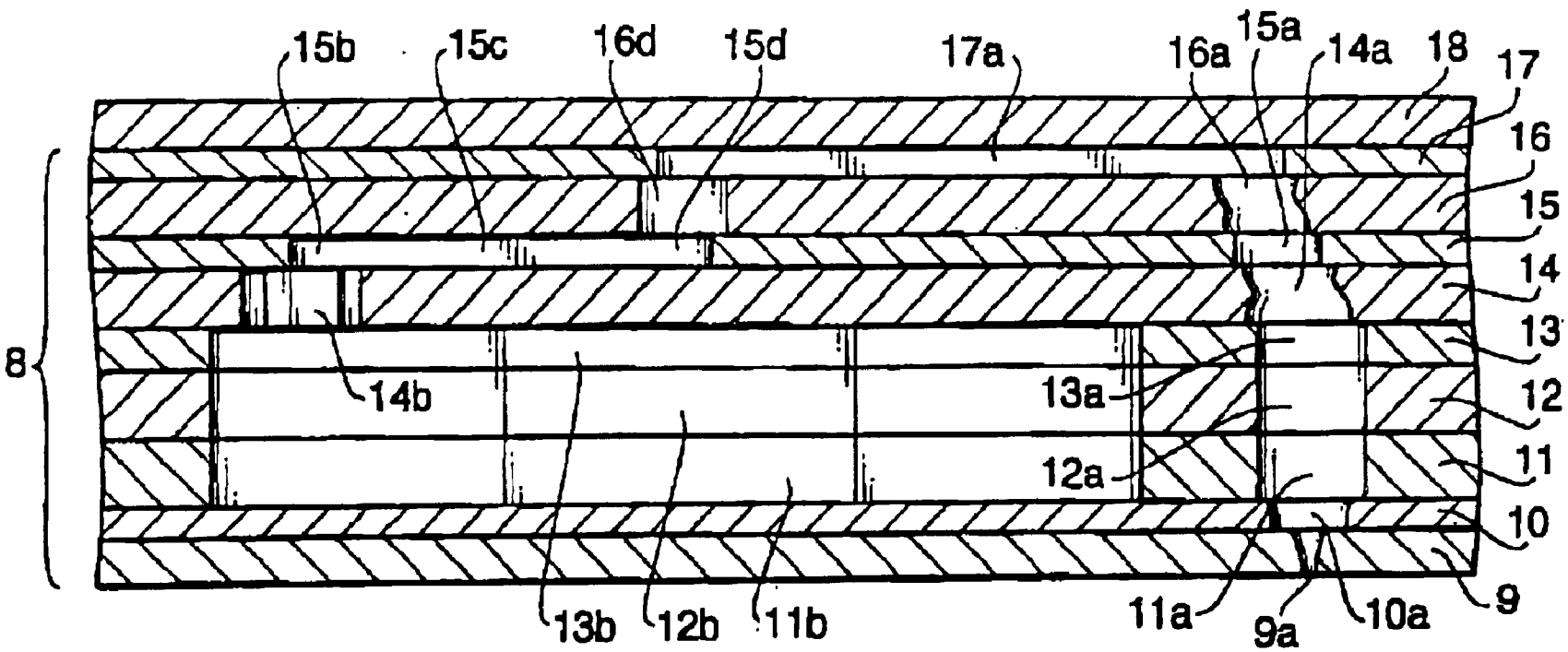
FIG. 2 is an enlarged sectional view of a primary part of the main body of the inkjet head.

FIG. 2 is an enlarged sectional view of a primary part of the main body 8 and the piezoelectric module 18.

Figure 1:
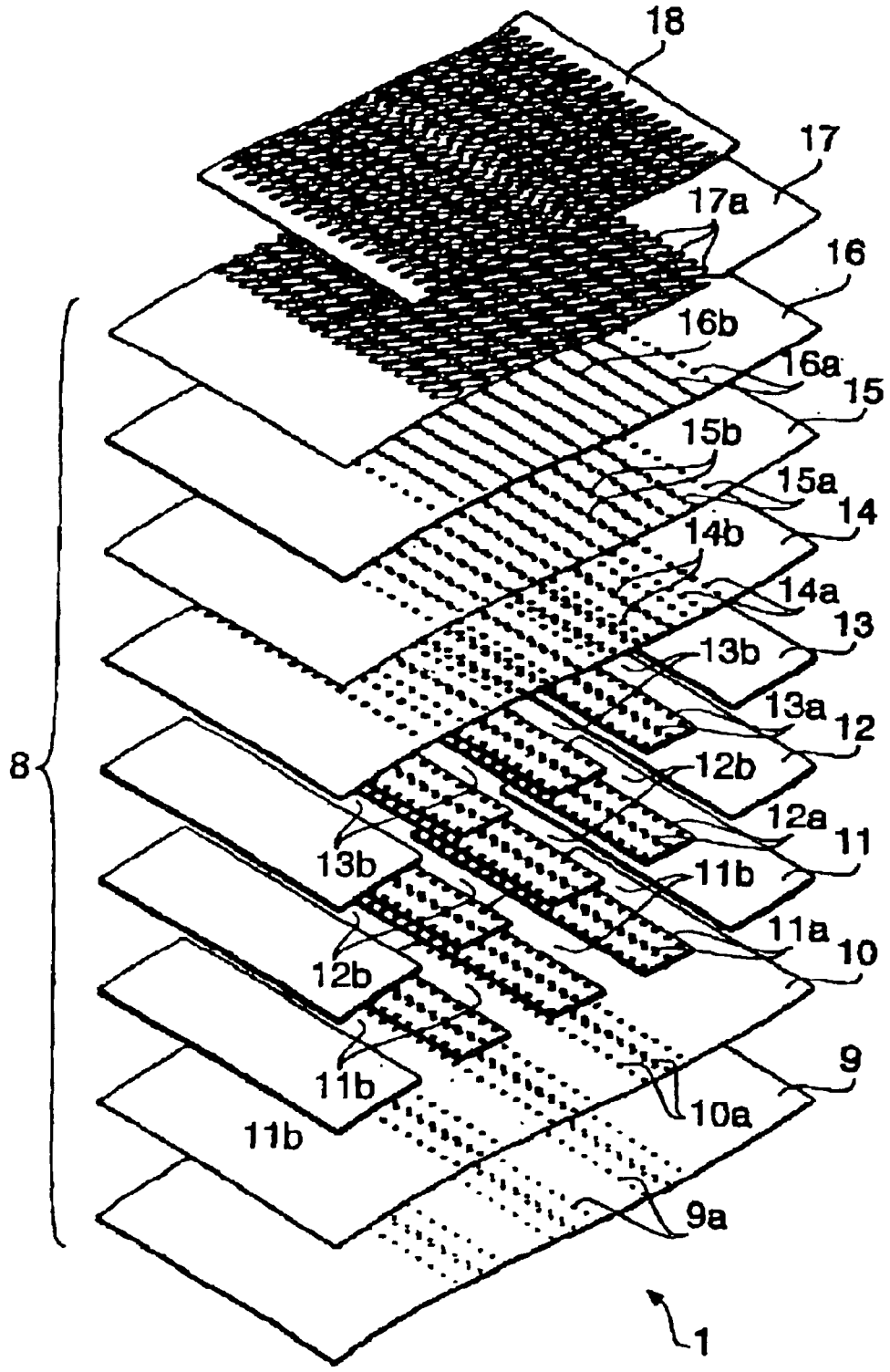
FIG. 1 is an exploded perspective view of a part of a main body of an inkjet head according to an embodiment of the invention.

FIG. 1 is an exploded perspective view of a part of the main body 8 and the ink ejecting module 18 according to the embodiment of the invention.

As shown in FIG. 1, the main body 8 includes a plurality of metal sheets, which are laminated with each other. Specifically, the main body 8 includes nine relatively thin plates having a substantially rectangular shape, which are, from the bottom layer, a nozzle plate 9, a cover plate 10, a first manifold plate 11, a second manifold plate 12, a third manifold plate 13, a supply plate 14, an aperture plate 15, a base plate 16 and a cavity plate 17. The nine plates are laminated and adhered with each other using adhesive agent. On the cavity plate 17, a trapezoidal piezoelectric unit 18, which will be described in detail later and is shown schematically in FIGS. 1 and 3.

On the nozzle plate 9, as shown in FIGS. 1 and 2, a plurality of fine-diameter nozzles 9*a* for ejecting ink are formed. A pitch of the nozzles 9*a* are defined at a pitch correspond to a printing resolution of 600 dpi.

Figure 5:
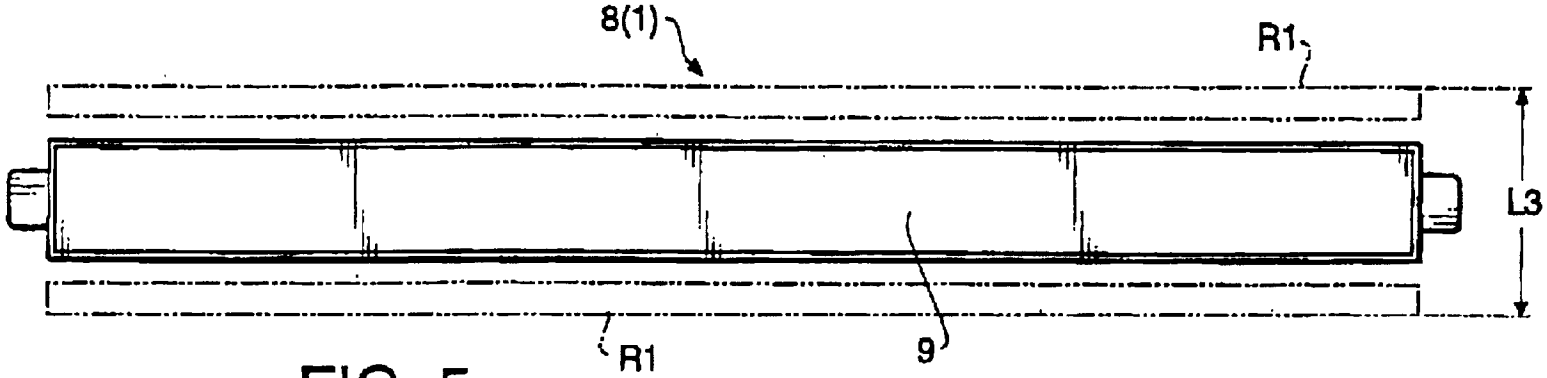
FIG. 5 is a bottom view of the inkjet head according the embodiment.

FIG. 5 is a bottom view of the inkjet head 1 according the embodiment. Viewed from the bottom surface of the inkjet head 1, the nozzle plate 9 is exposed to outside as shown in FIG. 5. Since the plurality of nozzles 9*a* are minute, indication thereof is omitted in FIG. 5 for the sake of simplicity.

On the cover plate 10, a plurality of through holes 10*a* which respectively communicate with the plurality of nozzles 9*a* are formed (see FIGS. 1 and 2). The through holes 10*a* serve as a part of ink channels.

On the first manifold plate 11, a plurality of through holes 11*a* respectively communicating with the plurality of fine diameter through holes 9*a* are formed, to defined a part of the ink channels. To the first manifold plate 11, an ink channel 11*b* (see FIGS. 1 and 2) which directs the ink from an ink inlet 17*a* (see FIG. 4) is defined. It should be noted that the structure of the main body will occasionally be described in relation to a single nozzle 9*a* for the sake of simplicity of description, although, as aforementioned, there are a plurality of ink channels 11*b*, and other components which will be described below provided in the main body 8.

On the second manifold plate 12, a plurality of fine diameter through holes 12*a* respectively communicating with the plurality of through holes 11*a* are formed (see FIGS. 1 and 2). On the second manifold plate 12, at a position corresponding to the ink channel 11*b*, an ink channel 12*b* is defined (see FIG. 2).

On the third manifold plate 13, a plurality of fine diameter through holes 13*a* respectively communicating with the plurality of through holes 12*a* are formed. On the third manifold plate 13, at a position corresponding to the ink channel 12*b*, an ink channel 13*b* is defined (see FIG. 2). There are three ink channels 11*b*, 12*b* and 13*b* (see FIGS. 1 and 2) which serve as a manifold MN, through which the ink is supplied to the inkjet head 1. The depth and width of the manifold MN is determined so as to supply a predetermined (sufficient) amount of ink.

On the supply plate 14, a plurality of fine diameter through holes 14*a* respectively communicating with the plurality of through holes 13*a* are formed. On the supply plate 14, at a position corresponding to the ink channel 13*b*, a through hole 14*b* is formed (see FIG. 2).

On the aperture plate 15, a plurality of fine diameter through holes 15*a* respectively communicating with the plurality of through holes 14*a* are formed. On the aperture plate 15, at a position corresponding to the through hole 14*b*, a through hole 15*b* is formed. The through hole 15*b* communicates with a narrowed channel 15*c* (see FIGS. 1, 2 and 6). On a position opposite to the through hole 15*b* with respect to the narrowed channel 15*c*, another through hole 15*d* is formed.

On the base plate 16, a plurality of fine diameter through holes 16*a* respectively communicating with the plurality of through holes 15*a* are formed (see FIGS. 1 and 2). Further, on the base plate 16, a plurality of through holes 16*b* through which the ink supplied from the apertural channel 15*c* passes are formed (see FIGS. 1 and 2).

Figure 6:
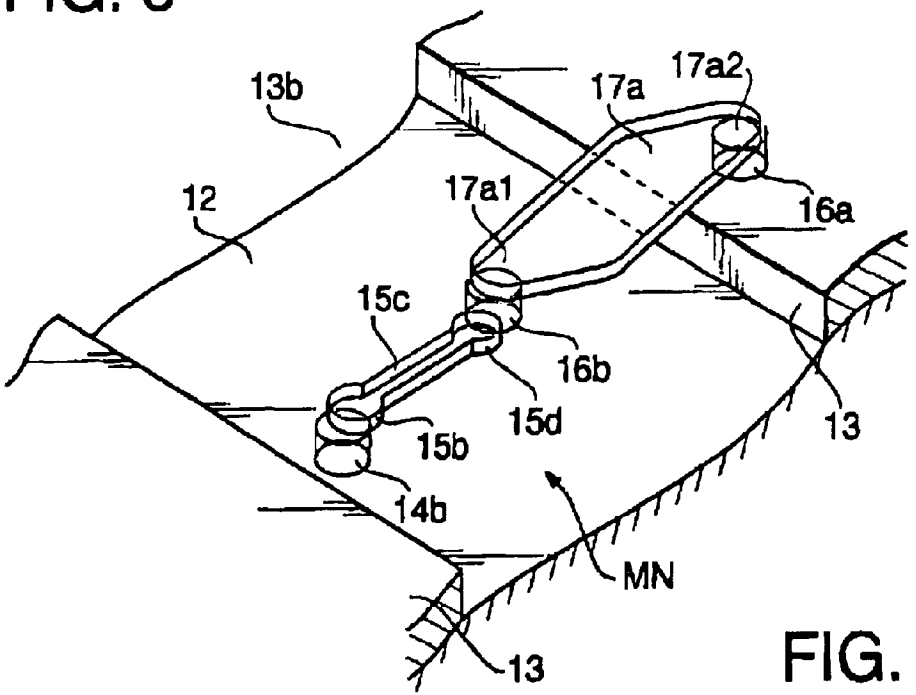
FIG. 6 is a perspective view schematically showing an ink channel of the inkjet head.

On the cavity plate 17, as shown in FIGS. 2, 3 and 6, a plurality of substantially rhombic pressure chambers 17*a* are arranged in matrix.

FIG. 6 is a perspective view schematically showing an ink channel of the inkjet head 1. As shown in FIG. 6, one acute angle corner 17*a*1 of each pressure chamber 17*a* communicates with the through hole 16*b* to introduce the ink in the pressure chamber 17*a*, and another acute angle corner 17*a*2 communicates with the through hole 16*a* to discharge the ink to the nozzle 9*a*. When a plurality of pressure chambers 17*a* are arranged, the acute angle corners 17*a*1 and 17*a*2 are located between acute angle corners of the adjoining pressure chambers 17*a* as shown in FIG. 3. Therefore, the substantially rhombic pressure chambers 17*a* can be arranged at high density.

As aforementioned, trapezoidal piezoelectric modules 18 are adhered on the cavity plate 17. To each of the piezoelectric modules 18, a plurality of piezoelectric unit structures 18*a* are arranged (see FIG. 3). The shape of each of the piezoelectric unit structures 18*a* corresponds to the shape of the pressure chamber 17*a*, and is formed to have a substantially rhombic shape. The piezoelectric unit structure 18*a* is slightly smaller in comparison with the size of the pressure chamber 17*a*. The plurality of piezoelectric unit structures 18*a* have one-to-one correspondence with respect to the plurality of pressure chambers 17*a*, and are capable of applying sufficient pressure to the ink within the pressure chambers 17*a* for ejection, respectively.

Acute angle corners of the piezoelectric unit structures 18*a* are located between the acute angle corners of the adjoining piezoelectric unit structures 18*a*, and therefore, they can be arranged at high density. As shown in FIG. 3, one acute angle corner of each piezoelectric unit structure 18*a* is formed in an arrow shape, which serves as an electrode of the piezoelectric unit structure 18*a*.

The main body 8 has a plurality of pressure chambers 17*a* which are formed at positions corresponding to the piezoelectric unit structures 18*a* as shown in FIG. 3. The main body 8 further includes manifolds MN for supplying the ink to each pressure chamber 17*a*, and the ink inlet 17*b* which communicates with the manifold MN and directs the ink from an ink reservoir (not shown) to the manifold MN. That is, the ink is fed from the ink reservoir to the manifold MN composed of the ink channels 11*b*, 12*b* and 13*b*.

The ink is supplied from the manifold MN to the pressure chambers 17*a*, via the through holes 14*b*, through holes 15*b*, the narrowed channels 15*c*, the through holes 15*d* and the through holes 16*b*. When the piezoelectric unit structures 18*a* are applied with a driving voltage, they deform to increase volume of each pressure chamber 17*a*, thereby, the ink in each pressure chamber 17*a* flows through the through holes 16*a*, 15*a*, 14*a*, 13*a*, 12*a*, 11*a* and 10*a*, and ejected from the nozzle 9*a*.

The inkjet head 1 is configured such that, on the main body 8 having the printing surface 8*a* which is an elongated rectangular surface, and a plurality of (twelve modules in FIG. 4) piezoelectric modules 18, each of which is provided with a plurality of piezoelectric unit structures 18*a*, are arranged in the longitudinal direction of the main body 8. The main body 8 is a line head whose length in its longitudinal direction is at least the width of the recording sheet. The recording sheet is to be fed in a direction perpendicular to the center line LO (see FIG. 4) of the printing surface 8*a*, and for this purpose, a pair of feeding rollers R1 and R1 are provided on both sides of the main body 8 (see FIG. 5).

Each piezoelectric module 18 has, as shown in FIG. 7, a trapezoidal shape. The piezoelectric modules 18 are arranged such that upper bases 19*a* of the trapezoidal shapes are located on the center line LO side and the lower bases 19*b* directed outer side. Adjoining piezoelectric modules 18 are oriented in opposite directions, therefore, the plurality of piezoelectric modules 18 are oriented in opposite directions alternately.

As shown in FIG. 7, each piezoelectric unit 18 has the upper base 19*a*, the lower base 19*b*, a first oblique side 19*c* connecting an end of the upper base 19*a* and an end of the lower base 19*b*, and a second oblique side 19*d* connecting the other ends of the upper and lower bases 19*a* and 19*b*. Between the adjoining piezoelectric units 18, the first oblique sides 19*c* face each other, and the second oblique sides 19*d* face each other.

As shown in FIG. 7, a first angle A1 formed between the lower base 19*b* and the first oblique side 19*c* and a second angle A2 formed between the lower base 19*b* and the second oblique side 19*d* are different. In the configuration shown in FIG. 7, the first angle A1 is greater than the second angle A2.

As shown in FIG. 4, all the piezoelectric modules 18 have the same shapes. Therefore, when they are formed by baking, only one kind of modules are sufficient, which reduces the manufacturing cost.

The piezoelectric modules 18 are arranged alternately on both sides of the central line LO, and the modules on both sides of the center line LO overlap in the width direction (i.e., a direction perpendicular to the center line LO). Therefore, the width of the inkjet head 1 can be made relatively small, which contributes to downsizing of the inkjet printing apparatus.

Further, as described above, the shape of a piezoelectric module 18 is not symmetrical along the longitudinal direction of the inkjet head 1, and the first angle Al is greater than the second angle A2.

As will be described later, it is required that a certain clearance is formed between the second oblique side 19*d* and an opposing side of the adjoining piezoelectric module 18. Even though the clearance is provided, the arrangement pitch of the nozzles 9*a* in the longitudinal direction of the printing surface 8*a* (i.e., a direction perpendicular to the sheet feeding direction) at a portion where the clearance is formed is the same as the arrangement pitch at a portion where the clearance does not exist, that is, the distribution of the nozzles 9*a* is maintained as a whole.

Further, the clearance is determined to provide a sufficient area for a first manifold MN1 and a second manifold MN2 as shown in FIG. 7 and will be described later.

As above, on one hand, the nozzles 9*a* should be arranged at a fixed pitch over the entire length of the printing surface 8*a*, on the other hand, a sufficient clearance should be provided between the oblique sides 19*d* of the adjoining piezoelectric modules 18. In order to satisfy both requirements (i.e., the pitch and the clearance), the second angle A2 is formed to be relatively gentle. While, between the first oblique sides 19*c* of the adjoining piezoelectric modules 18, such a clearance is not required.

Therefore, the first angle A1 can be relatively steep (i.e., large). With this configuration, if the first oblique sides 19*c* of the piezoelectric modules 18 are located at both ends of the main body 8 in the longitudinal direction thereof, the longitudinal length of the piezoelectric module 18 can be reduced in comparison with a case where the first angle A1 is as gentle as the second angle A2. As a result, the longitudinal length of the main body 8 can be shortened.

Furthermore, the ink inlets 17*b* should also be provided at areas surrounded by the piezoelectric modules 18 as shown in FIG. 7, and will be described in detail later. To provide sufficient areas for arranging the ink inlets 17*b*, it is preferable that the sides of the trapezoidal shape of the piezoelectric module 18 have relatively large angles.

According to the embodiment, with the above-configuration, for the main body 8 having a limited longitudinal length, it is possible that more piezoelectric modules 18 can be provided in comparison with a case where the first angle A1 is equal to the second angle A2 (i.e., the first angle A1 is as small as the second angle A2) with providing sufficient areas for arranging the ink inlets 17*b* and clearances between the second sides 19*d* of the adjoining piezoelectric modules 18. Therefore, according to the above-described structure, the utility efficiency is improved.

On the printing surface 8*a*, the trapezoidal piezoelectric units 18 are arranged such that the second oblique sides 19*d* of adjoining piezoelectric modules 18 are close to each other. Thus, the adjoining piezoelectric modules 18*a* can be arranged in a direction transverse to the central axis LO with a predetermined distance provided therebetween. With this configuration, at end portions of each piezoelectric module 18, the piezoelectric unit structures 18*a* can be arranged at a density (which will be referred to as a standard density hereinafter) along the center ling LO corresponding to the printing resolution of approximately 600 dpi.

As shown in FIG. 7, and briefly mentioned above, the first oblique side 19*c* faces the same side 19*c* of the adjoining piezoelectric module 18. Similarly, the second oblique side 19*d* faces the same side 19*d* of the adjoining piezoelectric module 18. In FIG. 7, the second oblique sides 19*d* of the adjoining piezoelectric modules 18 are spaced by a distance L1. Since the trapezoidal shape of the piezoelectric module 18 is formed as described above, the plurality of piezoelectric modules 18 are arranged such that a sufficient distance L1 is maintained, and further a distance L2 from the upper base of one piezoelectric unit 18 to the lower base of the adjoining piezoelectric unit 18 can be reduced. Thus, a space occupied, in the printing apparatus, by the inkjet head 1 and the sheet feeding mechanism in the sheet feed direction is reduced. Of course, in this case, the width of the inkjet head 1 itself can also be reduced, which contributes to downsizing of the inkjet printing apparatus.

The adjoining piezoelectric modules 18 can be arranged such that the oblique sides 19*c* (or 19*d*) thereof are close to each other. With such an arrangement, the lengths in the center line direction of the adjoining piezoelectric modules 18 partially overlap in a direction perpendicular to the center ling LO (it should be noted that the modules 18 are not actually overlap). Thus, at the boundary of the adjoining piezoelectric modules 18, the piezoelectric unit structures 18*a* can be arranged at the standard pitch (e.g., a pitch corresponding to the printing resolution of 600 dpi) along the direction of the center line LO without discontinuity. Of course, the closer the oblique sides 19*c* (or 19*d*) are, the smaller the width of the inkjet head 1 is, which contributes to downsizing of the inkjet head 1.

When a plurality of piezoelectric modules 18 are arranged, if the piezoelectric element unit structures 18*a* are evenly distributed in the direction perpendicular to the center line LO, due to the trapezoidal shape of the piezoelectric modules 18, the outermost portions 18*c* of the piezoelectric modules 18 (see FIG. 4) are not used.

As shown in FIGS. 4 and 7, the oblique sides 19*c* of the adjoining piezoelectric modules 18 overlap in the direction perpendicular to the center line LO. When a printing operation is performed, the piezoelectric unit structures 18*a* of adjoining piezoelectric modules 18 are used in combination to achieve the standard pitch corresponding to the print resolution of 600 dpi. For the outermost portions 18*c* of the outermost piezoelectric modules 18, there is no adjoining piezoelectric modules 18 to be used in combination with. Therefore, the outermost portions 18*c* are not used.

As appreciated from FIG. 4, if the oblique side 19*d* is located in the outermost portion of the piezoelectric modules 18, the outermost portion 18*c* is greater in comparison with a case where the oblique side 19*c* is located at the outermost portion 18*c*. By providing the first oblique sides 19*c* at the outermost portions 18*c* as shown in FIG. 4, the utility efficiency of the piezoelectric modules 18 is improved. That is, with this configuration, the number of wasted piezoelectric unit structures 18*a* is reduced. In other words, the utility efficiency of the piezoelectric modules 18 is increased.

Further, the contributory ratio of the piezoelectric unit structures 18*a* with respect to the longitudinal length of the inkjet head 1 is smaller when the first oblique sides 19*c* are located at the outermost sides of the outermost piezoelectric units 18.

In the above case, when the piezoelectric modules 18 are arranged on the printing surface 8*a*, which is an elongated rectangular surface, a space is defined by the upper base 19*a* of one piezoelectric module 18, and the first and second oblique sides 19*c* and 19*d* of the piezoelectric modules 18 adjacent to the one piezoelectric module 18. Within the space LL defined by the three lines 19*a*, 19*c* and 19*d*, that is on an upstream side (or downstream side) of each upper base 19*a*, two ink inlets 17*b* are provided as shown in FIG. 7.

As show in FIG. 7, the manifolds MN (i.e., channels 11*b*, 12*b* and 13*b*) extending from the right-hand side of the drawing extend along the center line LO. The extending direction of the manifolds MN extending from the right-hand side is substantially perpendicular to the first oblique side 19*c*. The second manifold MN2 extending from the left-hand side of the drawing forms a gentle curves so as to reduce resistance to ink flow and then extends in the direction parallel to the center line LO.

The second manifolds MN2 supplies the ink to the piezoelectric unit 18, which is shown at an upper left-hand portion in FIG. 7.

The first manifold MN1 extending from the left-hand side of the ink inlet 17*b* forms a gentle curve and then extends in a direction substantially parallel to the center line LO.

The first manifold MN1 is for supplying the ink to the piezoelectric unit 18 located at the center of the three in FIG. 7. The first manifold MN1 diverges into two channels at the piezoelectric unit 18 as shown in FIG. 7.

The manifold MN3 extending from the ink inlet 17*b* shown on the lower right-hand side of the drawing extends in the direction parallel to the center line LO. The extending direction of the third manifold MN3 is substantially perpendicular to the first oblique side 19*c* of the piezoelectric unit 18.

The first and second manifolds MN1 and MN2 are spaced by a distance L4 at the portion between the second oblique sides 19*b* of the adjoining piezoelectric units 18 as indicated in FIG. 7.

The ink supplied through the ink inlets 17*b* is directed to the pressure chambers 17*a* through the first and second manifolds MN1 and MN2. Therefore, it is advantageous that, with the first and second manifolds MN1 and MN2 spaced by a distance L4, sufficient amounts of ink can be supplied to each pressure chamber 17*a* with the mechanical rigidity of the inkjet head 1 itself being ensured. It should be noted that, since the second side 19*b* is an oblique side, the oblique sides 19*b* can be spaced sufficiently to achieve the necessary rigidity, and it is unnecessary to arrange the adjoining piezoelectric units 18 excessively spaced apart in the direction of the center line LO. That is, with the above configuration, the inkjet head can be downsized without deteriorating the mechanical rigidity thereof. Accordingly, the inkjet head is hardly deformed, and relatively high "land-in" accuracy of the ejected ink droplets can be achieved.

As described above, the inkjet head 1 is configured such that a plurality of piezoelectric unit structures 18*a* are arranged on the main body 8 which has a piezoelectric element arranging surface 8*a*. The surface 8*a* is formed to be an elongated rectangular shape. Each piezoelectric module 18 has a trapezoidal shape. The piezoelectric modules 18 are arranged such that the upper bases of the trapezoidal shapes are located close to the center line LO of the surface 8*a*, and are arranged to be alternately oriented in opposite directions. With this arrangement, a distance from an upper base of a piezoelectric module 18 to a lower base of an adjoining piezoelectric module 18 can be shortened. Therefore, the distance L3 of the inkjet head 1 and the sheet feed rollers R1 in the sheet feed direction can be reduced. Accordingly, a room of a printing apparatus for accommodating the inkjet head 1 and the rollers R1 can be made small.

It should be noted that the present invention is not limited to the configuration described above, and can be modified in various way without departing from the gist of the invention.

For example, in the above-described embodiment, twelve lines of the pressure chambers 17*a* are provided on the main body 8. However, it can be modified to four, eight or other number of lines. Further, the number of the piezoelectric element arranging surfaces 18*a* need not be limited to 12, and another number may be employed.

In the above-described embodiment, the piezoelectric unit structures 18*a* are arranged at a pitch corresponding to the printing resolution of 600 dpi. The invention needs not be limited to this resolution, and the piezoelectric unit structures 18*a* can be arranged at a pitch corresponding to different print resolution, for example, the resolution of 300 dpi.

In the above-described embodiment, the inkjet head 1 has length substantially the same as the width of the recording sheet, and the recording sheet is fed in a direction perpendicular to the longitudinal direction of the inkjet head 1. It should be noted that such a structure is only an exemplary structure, and can be modified in various ways.

In the above-described embodiment, each of the pressure chambers 17*a* has a substantially rhombic shape. However, another shape can be employed.

According to the above-described embodiment, there is provided an inkjet head employed in an inkjet printing apparatus, which is provided with a main body provided with a printing surface having a substantially rectangular elongated shape, and a plurality of piezoelectric modules. Each of the piezoelectric modules has a substantially trapezoidal shape, and is provided with a plurality of piezoelectric unit structures. The plurality of piezoelectric modules are arranged along a longitudinal direction of the printing surface such that upper base of the trapezoidal shape is located at a central portion in a direction perpendicular to the longitudinal direction. Further, the plurality of piezoelectric modules are oriented in opposite directions alternately in the direction perpendicular to the longitudinal direction.

With this configuration, the inkjet head can be downsized, and thereby a space occupied by the inkjet head and sheet feed mechanisms employed in the inkjet printing apparatus can be reduced.

In a particular case, all the trapezoidal shape may be identical. Accordingly, fabrication process for the piezoelectric modules can be simplified, which reduces the fabrication cost.

Optionally, the trapezoidal shape may be formed such that a first angle, which formed by the lower base and a first side connecting one side of the upper base and one side of the lower base, is different from a second angle, which formed by the lower base and a first side connecting the other side of the upper base and the other side of the lower base.

In a particular case, the first angle may be greater than the second angle, and the plurality of piezoelectric modules may be arranged on the printing surface such that the end sides of the arranged plurality of piezoelectric modules are the first sides.

With this arrangement, the utility efficiency of the piezoelectric structures is improved.

Optionally, at least two adjoining piezoelectric modules may be arranged such that the second sides thereof face each other with a predetermined distance therebetween.

Further optionally, the main body may be defined with a plurality of pressure chambers located at positions corresponding to the plurality of piezoelectric unit structures and manifolds through which ink is supplied to the plurality of pressure chambers. The manifolds may include a first manifold and a second manifold at an area defined by the second sides of the trapezoidal shapes of each adjoining two piezoelectric modules. In this case, the first manifold and second manifold may be spaced by a predetermined distance at the area defined by the second sides of each adjoining two piezoelectric modules.

Further optionally, the inkjet head may include ink inlets through which ink is supplied to the inkjet head, the ink inlets being arranged at portions corresponding to areas each surrounded by three adjoining piezoelectric modules.

The present disclosure relates to the subject matters contained in Japanese Patent Applications No. 2001-367701, filed on Nov. 30, 2001, and No. 2001-371148 filed on Dec. 5, 2002, which are expressly incorporated herein by reference in their entireties.

What is claimed is:

1. An inkjet head for an inkjet printing apparatus, comprising:

a main body provided with a printing surface having a substantially rectangular elongated shape;

a plurality of piezoelectric modules, each of said piezoelectric module having a substantially trapezoidal shape, each of said plurality of piezoelectric modules being provided with a plurality of piezoelectric unit structures, wherein said plurality of piezoelectric modules are arranged along a longitudinal direction of said printing surface such that upper base of the trapezoidal shape is located at a central portion in a direction perpendicular to the longitudinal direction, said plurality of piezoelectric modules being oriented in opposite directions alternately in the direction perpendicular to the longitudinal direction.

2. The inkjet head according to claim 1, said trapezoidal shape being formed such that a first angle, which formed by the lower base and a first side connecting one side of the upper base and one side of the lower base, is different from a second angle, which formed by the lower base and a second side connecting the other side of the upper base and the other side of the lower base.

3. The inkjet head according to claim 2, wherein the first angle is greater than the second angle, and wherein said plurality of piezoelectric modules are arranged on said printing surface such that the end sides of the arranged plurality of piezoelectric modules are the first sides.

4. The inkjet head according to claim 3, wherein at least two adjoining piezoelectric modules are arranged such that the second sides thereof face each other with a predetermined distance therebetween.

5. The inkjet head according to claim 3, wherein said main body is defined with:

a plurality of pressure chambers located at positions corresponding to said plurality of piezoelectric unit structures; and manifolds through which ink is supplied to said plurality of pressure chambers, wherein said manifolds include a first manifold and a second manifold at an area defined by the second sides of the trapezoidal shapes of each adjoining two piezoelectric modules, said first manifold and second manifold being spaced by a predetermined distance at said area defined by the second sides of each adjoining two piezoelectric modules.

6. The inkjet head according to claim 2, wherein at least two adjoining piezoelectric modules are arranged such that the second sides thereof face each other with a predetermined distance therebetween.

7. The inkjet head according to claim 6, wherein the first angle is greater than the second angle, and wherein said plurality of piezoelectric modules are arranged on said printing surface such that the end sides of the arranged plurality of piezoelectric modules are the first sides.

8. The inkjet head according to claim 7, wherein said main body is defined with:

a plurality of pressure chambers located at positions corresponding to said plurality of piezoelectric unit structures; and manifolds through which ink is supplied to said plurality of pressure chambers, wherein said manifolds include a first manifold and a second manifold at an area defined by the second sides of the trapezoidal shapes of each adjoining two piezoelectric modules, said first manifold and second manifold being spaced by a predetermined distance at said area defined by the second sides of each adjoining two piezoelectric modules.

9. The inkjet head according to claim 1, further including ink inlets through which ink is supplied to said inkjet head, said ink inlets being arranged at portions corresponding to areas each surrounded by three adjoining piezoelectric modules.

10. The inkjet head according to claim 1, wherein all the trapezoidal shapes are identical.

* * * * *